US007022982B2

(12) United States Patent
Sobek et al.

(10) Patent No.: US 7,022,982 B2
(45) Date of Patent: Apr. 4, 2006

(54) ION SOURCE FREQUENCY FEEDBACK DEVICE AND METHOD

(75) Inventors: Daniel Sobek, Portola Valley, CA (US); Jing Cai, Stanford, CA (US); Kevin Killeen, Palo Alto, CA (US); Hongfeng Yin, Cupertino, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 56 days.

(21) Appl. No.: 10/896,981

(22) Filed: Jul. 23, 2004

(65) Prior Publication Data

US 2005/0178974 A1 Aug. 18, 2005

Related U.S. Application Data

(60) Provisional application No. 60/543,542, filed on Feb. 12, 2004.

(51) Int. Cl.
*H01J 49/10* (2006.01)

(52) U.S. Cl. ..... 250/288; 250/423 R

(58) Field of Classification Search ..... 250/288, 250/423 R, 424
See application file for complete search history.

(56) References Cited

U.S. PATENT DOCUMENTS 6,952,013 B1 * 10/2005 Granger et al. ..... 250/288

FOREIGN PATENT DOCUMENTS

WO WO 02/095362 11/2002

OTHER PUBLICATIONS

Bruins A.P. , "Mechanistic aspects of electrospray ionization," Journal of Chromatography A, vol. 794, pp. 345-347, 1998.
Cech et al., "Practical implications of some recent studies in electrospray ionization fundamentals," Mass Spectrometry Reviews, vol. 20, pp. 362-387, Nov. 16, 2001.
Taylor G. I., "Disintegration of water drops in an electric field,"Proceedings of the Royal Society of London, vol. A280, pp. 383-397, Feb. 21, 1964.
R. Juraschek and F. W. Röllgen, "Pulsation phenomena during electrospray ionization," International Journal of Mass Spectrometry, 177:1-15, Apr. 6, 1998.
Lee, et al., "Taylor cone stability and ESI performance for LC-MS at low flow rates," Proceedings of the American Society of Mass Spectrometry, Jun. 2-6, 2002.

* cited by examiner

*Primary Examiner*—Kiet T. Nguyen

(57) ABSTRACT

An ion source for an analytical instrument is described. The ion source comprises a capillary tip and counter-electrode interface and a feedback loop control device connected to the capillary tip and counter-electrode interface. The feedback loop control device comprises a transimpedance amplifier, a DC de-coupler, a frequency to voltage converter, a controller, and a voltage-controlled high-voltage power supply that provides a tip to counter-electrode voltage to the capillary tip and counter-electrode interface. The feedback loop control device measures the modulation frequency of ionization currents and provides a feedback adjustment of the tip-to-counter-electrode voltage to maintain ionization efficiency.

21 Claims, 6 Drawing Sheets

ION SOURCE FREQUENCY FEEDBACK DEVICE AND METHOD

CROSS REFERENCE TO RELATED APPLICATION(S)

This application claims priority of provisional application Ser. No. 60/543,542, filed Feb. 12, 2004, entitled "MASS-SPECTROMETER SIGNAL OPTIMIZATION EMPLOYING ELECTROSPRAY FREQUENCY FEEDBACK," of which the subject matter is herein incorporated by reference in its entirety.

TECHNICAL FIELD

The technical field is analytical instruments and, in particular, signal optimization for mass spectrometers.

BACKGROUND

Electrospray ionization (ESI) is a technique for transporting bio-molecules diluted in a liquid into a gaseous phase. This desolvation method is customarily used for mass-spectrometry identification of proteins. For example, proteolytic enzymes are employed to digest proteins into unique peptide segments. These segments are then separated through reverse-phase High-Pressure-Liquid-Chromatography (HPLC) and sequentially electro-sprayed into a mass spectrometer. By determining the amino acid sequence of specific peptide segments, the mass-spectrometer yields sufficient information to identify the protein with high confidence.

The fundamental physics of the ESI process has been the subject of numerous investigations (for reviews of recent development in this field, see Bruins A. P., "Mechanistic aspects of electrospray ionization," *Journal of Chromatography A,* vol. 794, pp. 345–347, 1998; and Cech et al., "Practical implications of some recent studies in electrospray ionization fundamentals," *Mass Spectrometry Reviews*, vol. 20, pp. 362–387, 2001). An electrospray produces a cloud of ions in the gaseous phase. In a nano-ESI mode favored for applications in proteomics, the electrospray is established by pumping an analyte solution at slow flow rates (100–1000 nl/min) through a small bore capillary placed within a high electric field. When the analyte sample leaves the capillary and enters the high electric field in small droplets, the combined electro-hydrodynamic force on the liquid is balanced by its surface tension, effectively creating a "Taylor cone." (Taylor G. I., "Disintegration of water drops in an electric field," *Proceedings of the Royal Society of London*, vol A280, pp. 383–397, 1964).

The Taylor cone may exhibit different modes of behavior depending on the applied far-field electric field (i.e., voltage divided by the tip to counter-electrode spacing). There are four general regimes of operation for a fixed tip to counter-electrode distance and increasing voltage: (a) a pulsating mode, (b) a constant-amplitude oscillation mode, (c) a "cone-jet" mode, and (d) a "multi-jet" mode at the highest biases. Each mode generates a given distribution of droplet sizes, with each droplet carrying charge. The pulsating mode generally produces droplets of a large distribution in size and charge, which cause fluctuation in total ion current and yield a high degree of non-specific "chemical noise" to the mass spectrum. The pulsating mode also exhibits a pulsing behavior that creates poor reproducibility in signal measurement. In contrast, the constant-amplitude oscillation, cone-jet, and multi-jet modes produce smaller droplets having a higher charge-to-mass ratio and a narrow distribution in both diameter and charge state. The multi-jet mode, however, is undesirable because at such high fields there is a potential for arcing between the tip and counter-electrode. Attempts have been made to optimize the droplet size distribution and ion signal intensities by maintaining the electrospray in the cone-jet mode (note that the stable oscillation mode is sometimes lumped with the cone-jet mode). One approach is to visualize the electrospray nozzle through a microscope or video camera. An operator can then manually adjust parameters such the voltage or the distance between the tip of the capillary and the counter-electrode (i.e., tip to counter-electrode voltage or distance) until a satisfactory spray pattern is achieved. The method, however, requires constant operator attention and adjustment, and does not respond to varying conditions unless the operator observes and reacts to such changing conditions. Recently, PCT publication WO 02/095362 A2 describes an automatic feedback control system for an electrospray nozzle. The automatic feedback control system uses an optical system to monitor the geometry of the Taylor cone and control the spray pattern by adjusting tip to counter-electrode voltage or distance until a desired spray morphology is achieved. This feedback control system, however, requires large, expensive, and delicate optical instruments for image capture and analysis.

Another approach is to monitor the ion current generated by the electrospray process and adjust parameters until an ion current of satisfactory magnitude or stability is obtained the disadvantage with this approach is that ion current is dependent on the chemical nature of the sample liquid. A change in the chemical composition of the sample liquid will change the ion current. Accordingly, the system must be re-tuned when the chemical composition of the sample liquid changes.

Therefore, a need still exists for an electrospray control system that can effectively control the spray under changing sample conditions to maintain the ionization efficiency.

SUMMARY

An ion source for controlling ion spray is described. The ion source comprises a capillary tip; a counter-electrode comprising an aperture for receiving ions ejected from the capillary tip; and a closed feedback loop for coupling the capillary tip to the counter-electrode and regulating a spray of ions ejected from the capillary tip. The closed feedback loop maintains ionization efficiency by measuring a modulation frequency of ionization currents and adjusting a tip to counter-electrode voltage.

Also disclosed is a mass spectrometry system comprising the ion source described above and a detector downstream from the ion source for detecting the ions produced from the ion source.

Also disclosed is a method for providing ions to a mass spectrometer. The method comprises sensing a modulation frequency of an ionization current between a capillary tip and a counter-electrode; determining an ionization efficiency based on the modulation frequency of the ionization current; and controlling the ionization efficiency by adjusting the tip-to-counter-electrode voltage.

BRIEF DESCRIPTION OF THE DRAWINGS

The detailed description will refer to the following drawings, in which like numerals refer to like elements.

DETAILED DESCRIPTION

Figure 1A:
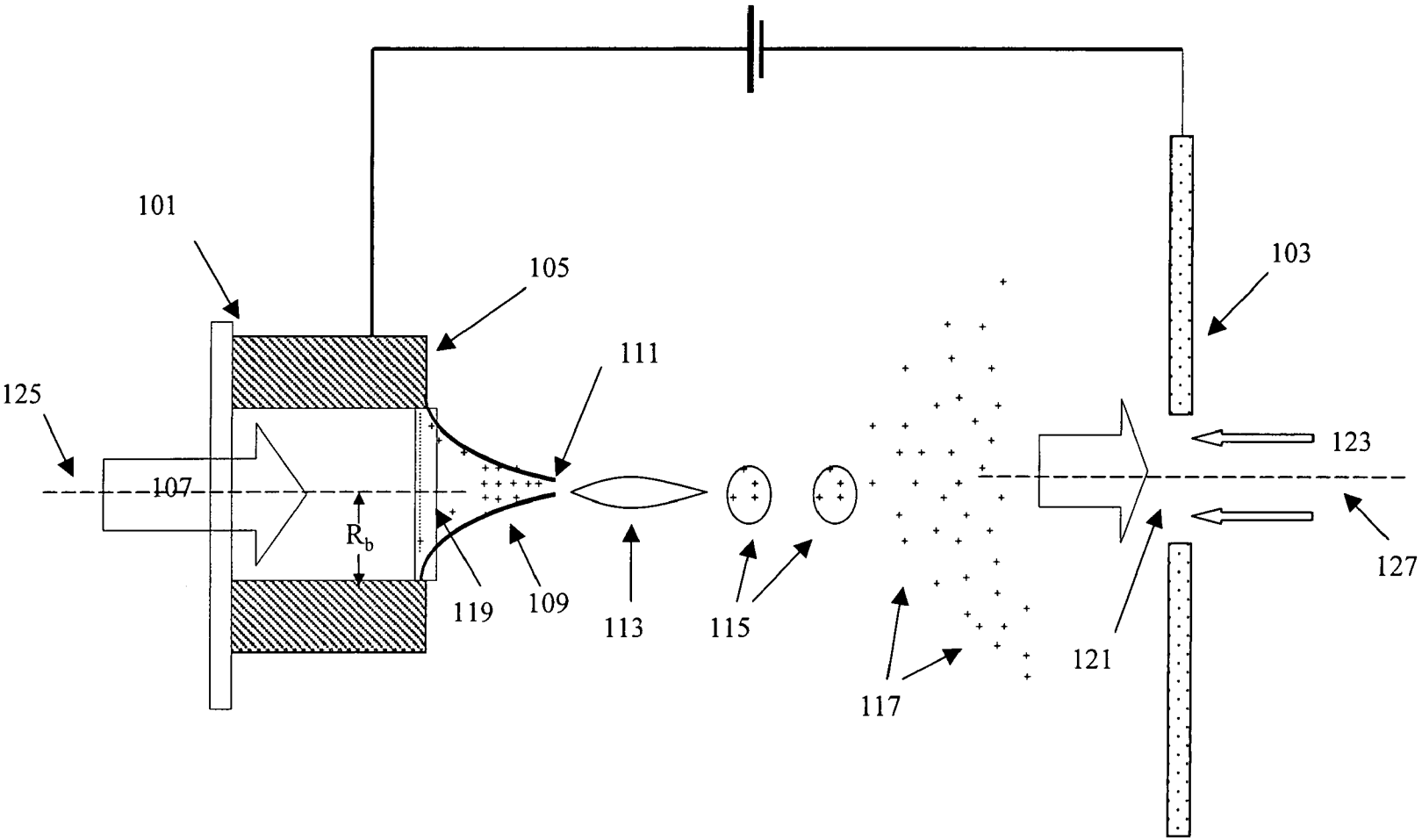
FIGS. 1A and 1B are schematic representations of the ionization process.

FIG. 1 is a schematic representation of an ionization process. As shown in FIG. 1, the placement of a capillary 101 in the vicinity of a counter-electrode 103 at high negative bias creates an electric field gradient at a capillary tip 105 of the capillary 101. A sample fluid 107 flowing through the capillary 101 exits out of the capillary 101 at the capillary tip 105. The jump in displacement flux density at the liquid-gas interface generates a surface charge, which in turn pulls the sample fluid 107 towards the counter-electrode 103. The combined electro-hydrodynamic force on the sample fluid 107 is balanced by the surface tension of the sample fluid 107, effectively creating a Taylor cone 109 having a base 119 and a tip 111. The tip 111 of the Taylor cone 109 extends into a micron-size filament 113. Moving downstream from the filament 113, interfacial forces from surface tension and charge repulsion coupled with small perturbations result in the breakup of the filament 113 and the formation of a stream of droplets 115. As these droplets 115 move further toward the counter-electrode 103, they experience charge driven coulombic explosions and "evaporation" and form a gaseous cloud of ions 117 (i.e. desolvation of the ions 117).

In a conventional capillary tip and counter-electrode interface, the counter-electrode 103 has an aperture 121 at its center. The ions 117 are then collected by the counter-electrode 103 and led through the aperture 121 into the mass-spectrometer. Typically, a drying gas (e.g. nitrogen) flow 123 in the direction opposite to the ion movement is employed to improve ionization efficiency and prevent the unintended introduction of drops and liquid vapor into the aperture 121. The term "ionization efficiency" is defined as the ratio of the number of ions formed to the number of electrons or photons used in an ionization process.

Figure 1B:
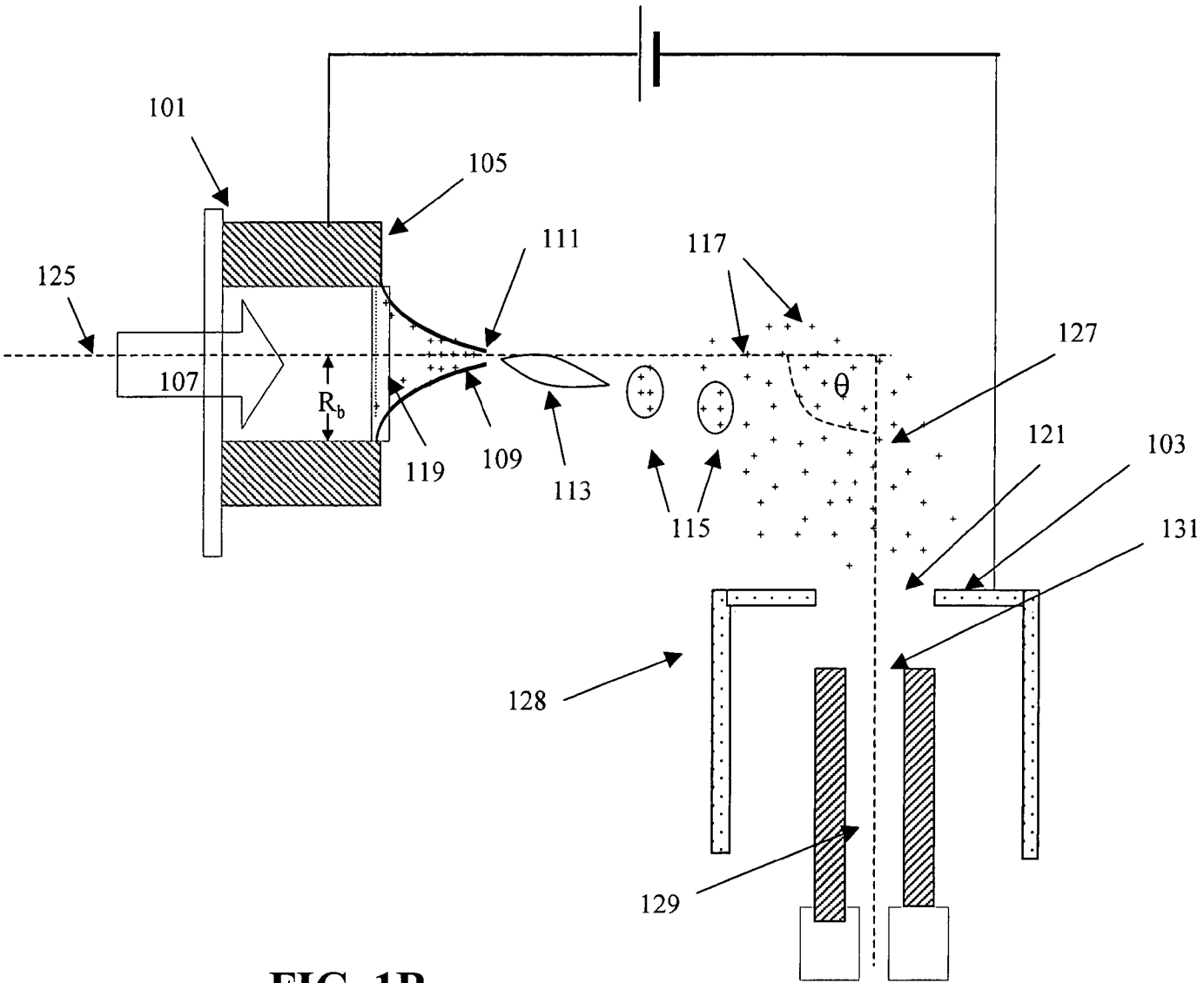

The aperture 121 can be placed anywhere downstream from the capillary tip 105, from a longitudinally position (FIG. 1A) to an orthogonal position (FIG. 1B). In other words, the angle (θ) defined by a central longitudinal axis 125 of the capillary tip 105 and a central axis 127 of the aperture 121 may vary from about 0° to about 180° (see FIG. 1B). In one embodiment, the angle θ is between about 75° to about 105°. In another embodiment, the aperture 121 is placed orthogonally (θ=90°) downstream from the capillary tip 105 (FIG. 1B). In this embodiment, the counter electrode 103 is part of a housing structure 128 that surrounds a passageway 129 leading to a mass spectrometer. Alternatively, the counter electrode 103 itself may form the housing structure 128. The passageway 129 is situated along the center axis 127 of the counter electrode 103 and has an orifice 131 proximate to the aperture 121 for receiving at least a portion of ions 117.

Electrospray ion sources produce distinct electrical signals based on the characteristics of the droplet formation process at the tip 111 of the Taylor cone 109. The current experiences transient fluctuations in amplitude (i.e., it is modulated) depending on how the surface charge is ejected from the tip 111 of the Taylor cone 109.

Using electrospray current measurements and Taylor cone visualization, Juraschek and Röllgen measured three ESI modes for electrospray ion sources operating at relatively high flow rates (2 μl/min): a pulsating mode with variable amplitude pulses (i.e., fast pulsations modulated by a low-frequency envelope, mode I), a constant amplitude higher frequency modulation mode with oscillation frequencies ranging from 1 to 3 kHz with increasing voltage (mode II), and a continuous emission mode for still higher voltages (for circuitry capable of measuring perturbations up to 1 MHz, mode III). (R. Juraschek and F. W. Röllgen, "Pulsation phenomena during electrospray ionization," *International Journal of Mass Spectrometry,* 177:1–15, 1998). Among these three modes, mode II and mode III provide the most desired ionization pattern. The mode II modulation was attributed to axial oscillatory movement of the Taylor cone. Using single point optical measurements, Lee et al. measured pulsations at frequencies greater than 100 kHz (Lee, et al., "Taylor cone stability and ESI performance for LC-MS at low flow rates," *Proceedings of the American Society of Mass Spectrometry,* 2002). There are no reports of electrical measurements at such frequencies. However, as discussed in more detail in the following paragraphs, the electrical measurements can be made with a properly designed circuitry.

Figure 2:
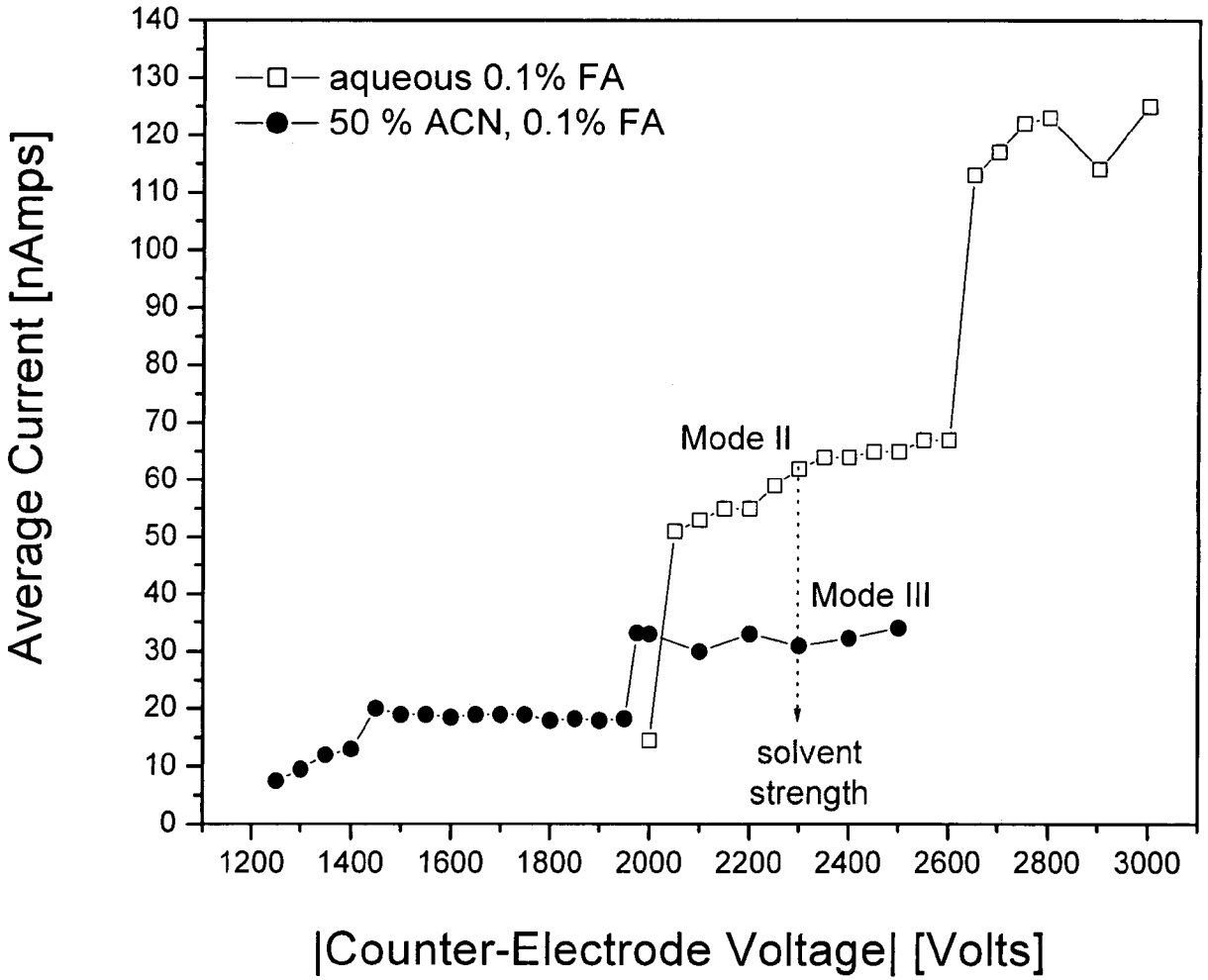
FIG. 2 shows the average electrospray current as a function of tip to counter-electrode voltage for a 2 mm tip to counter-electrode distance for two different liquid compositions. The tip used for this experiment was a 30 μm ID/OD New Objective tip. The liquids were pumped through the tip at a flow rate of 300 nl/min. Typically, during an HPLC gradient elution run, the tip to counter-electrode voltage is kept constant. In this example, the voltage is kept at 2300 V as shown by the dotted arrow.

The dynamic behavior of the Taylor cone for electrosprays is also affected by the chemical composition of the liquid carrying the sample, such as the mobile phase in the HPLC run. In a typical HPLC gradient elution, the capillary tip to counter-electrode voltage is kept constant during the elution and, as the mobile phase composition is changed, the ESI modulation frequency and even its mode of operation changes. As shown in FIG. 2, the ESI mode transitions from mode II (i.e., constant amplitude current modulation) to mode III (i.e., no ESI modulation) as the sample liquid composition is changed from aqueous with 0.1% formic acid to 50:50 water:acetonitrile with 0.1% formic acid.

Figure 3:
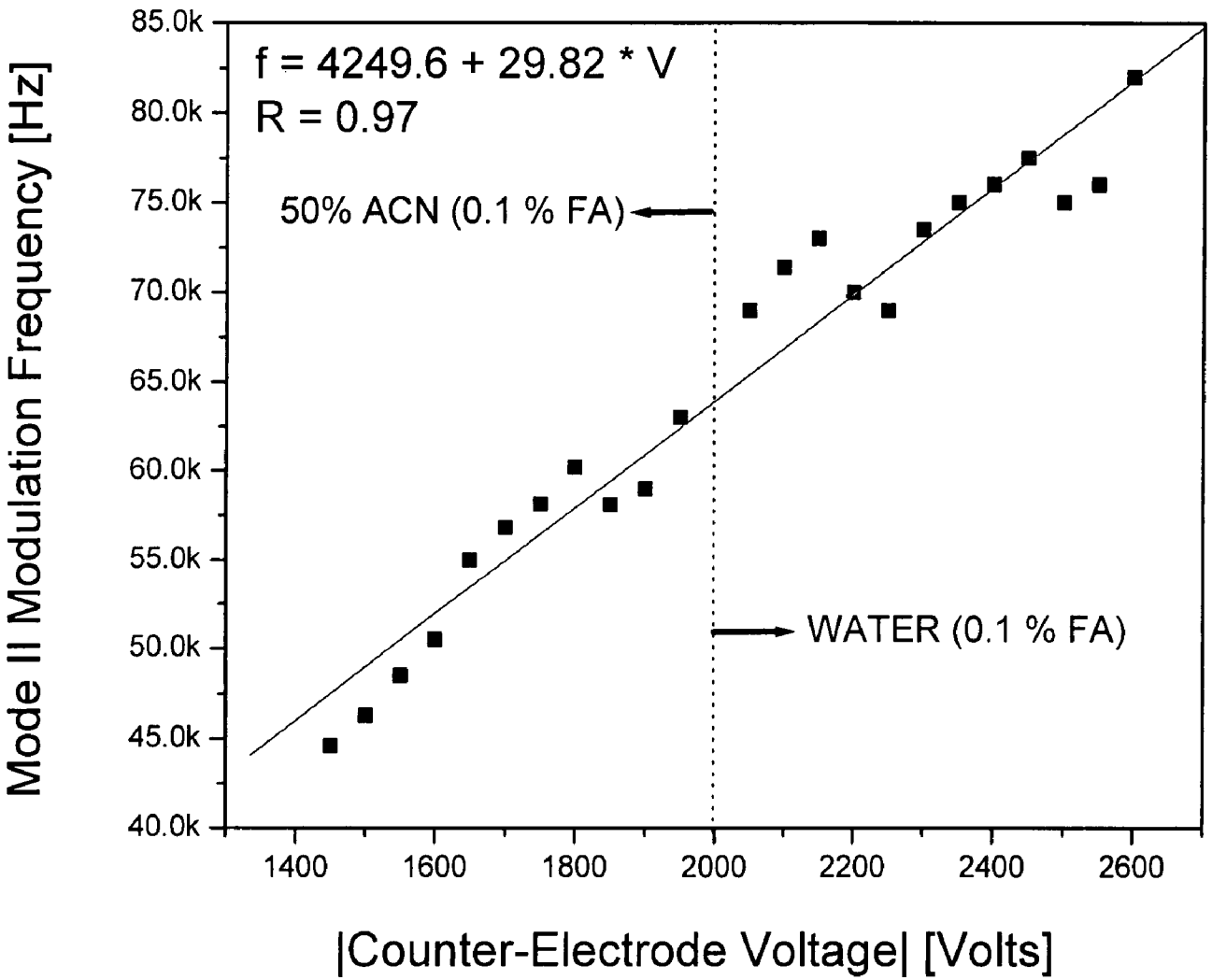
FIG. 3 shows the constant amplitude modulation frequency (Mode II) as a function of tip to counter-electrode voltage using a 2 mm tip to counter-electrode distance. The tip used for this experiment was a 30 μm ID/OD New Objective tip. The liquids were pumped through the tip at a flow rate of 300 nl/min.

FIG. 3 is a plot showing the modulation frequency of the ESI current in Mode II for the measurement shown in FIG. 2. The modulation frequency of the ESI current increases with the capillary tip to counter-electrode voltage and surface tension of the fluid (A rough model suggests a dependence that is proportional to the square root of the surface tension and inversely proportional to the radius of the base of the Taylor cone). For a 30 μm diameter capillary tip, the Mode II modulation may reach frequencies in excess of 80 kHz. The correlation between the modulation frequency of the ESI current in Mode II with the applied capillary tip to counter-electrode bias for different mobile phase compositions suggests that it is possible to use the modulation frequency to assess the droplet formation efficiency. Further, the frequency information may be employed to adjust the capillary tip to counter-electrode bias to yield the greatest charge to droplet size ratio for a given mobile phase composition.

Figure 4:
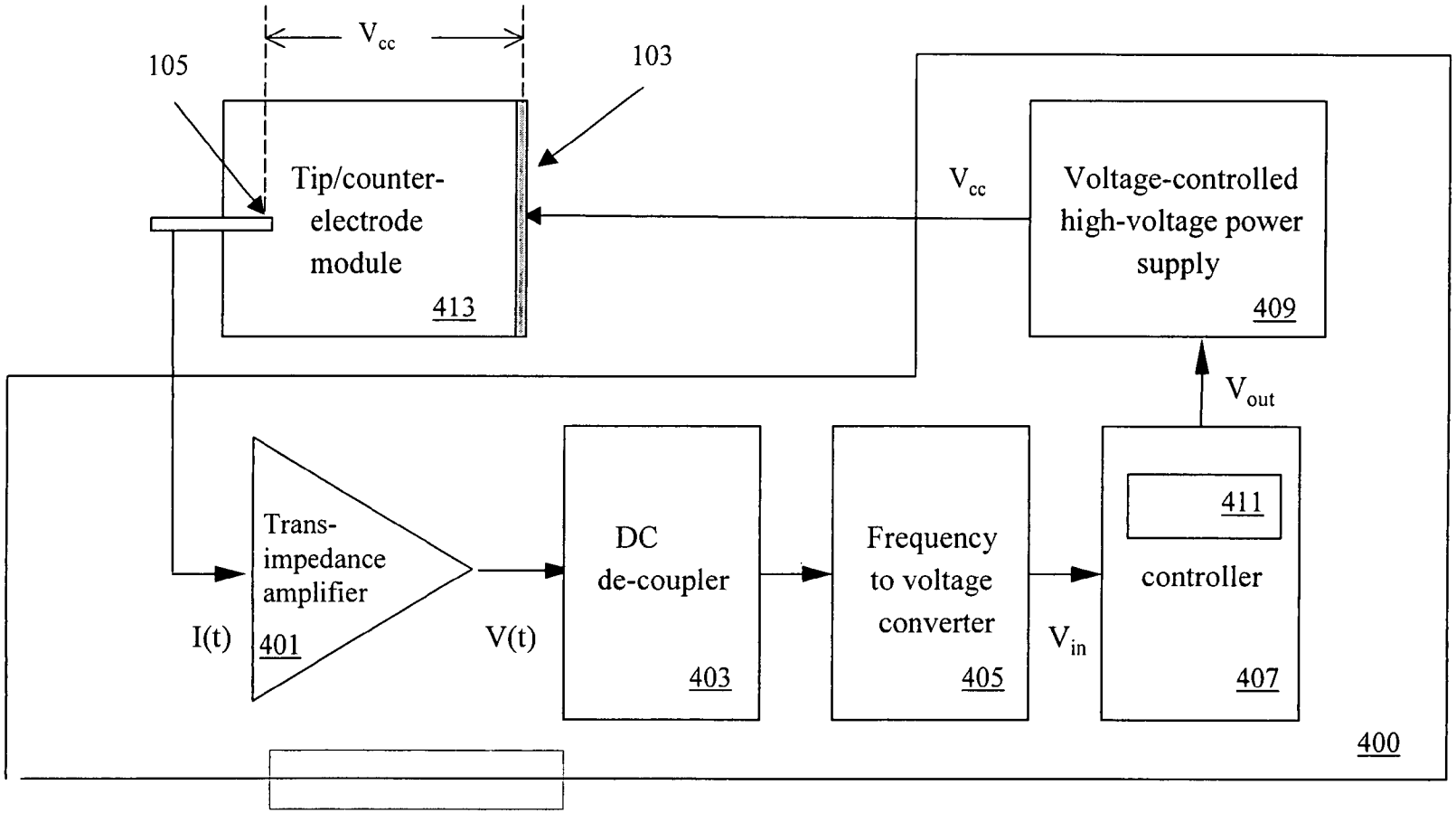
FIG. 4 is a block-diagram of a device for optimizing ion spray using a feedback control loop. The modulation frequency information from the ionization current is employed to actively adjust the tip to counter-electrode voltage according to a given algorithm programmed into the controller.

FIG. 4 shows an embodiment of a device 400 for adjusting electrospray conditions. In this embodiment, the device 400 contains a transimpedance amplifier 401, a DC de-coupler 403, a frequency to voltage converter 405, a controller 407, and a voltage-controlled high-voltage power supply 409. The device 400 measures the modulation frequency of the ESI current between a capillary tip 105 and a counter-electrode 103 in a capillary tip and counter-electrode module 413, and provides a feedback adjustment of capillary tip to counter-electrode voltage to adjust the electrospray conditions.

The transimpedance amplifier 401 converts ESI currents I(t) into voltages V(t). Since the average nano-flow ESI currents I(t) range between 5 and 150 nA, and may exhibit modulation up to 200 KHz, the transimpedance amplifier 401 should have a bandwidth of at least 400 kHz and a gain of $10^7$. Amplifiers with such specifications are commercially available. Alternatively, the transimpedance amplifier 401 can be built using a two-stage Op-Amp design, i.e., a low noise trans-impedance module for the current to voltage conversion, and a boost Op-Amp stage for further signal amplification.

The DC de-coupler removes the DC component of the electrospray signal. The frequency to voltage converter 405 responds to the input frequency of V(t) and delivers to the controller 407 a controller input voltage $V_{in}$ that is linearly proportional to the input frequency. In other words, the transimpedance amplifier 401, the DC de-coupler 403, and the frequency to voltage converter 405 function to convert the frequency information from ESI currents I(t) to the controller input voltage $V_{in}$.

The controller 407 contains a microprocessor 411 that analyzes the input voltage $V_{in}$ and generates an output voltage $V_{out}$ according to a given algorithm programmed into the controller 407. The output voltage $V_{out}$ controls the voltage-controlled high-voltage power supply 409, which maintains the capillary tip to counter-electrode voltage Vcc in the capillary tip/counter-electrode module 413 that is proportional to the output voltage $V_{out}$. The capillary tip to counter-electrode voltage Vcc can be a DC voltage or a DC voltage with an AC component. In this embodiment, the voltage Vcc is applied to the counter-electrode 103, and the measurement electronics (i.e. the transimpedance amplifier 401) is connected to the capillary tip 105. Typically, the capillary tip 105 is grounded and it is more practical to connect the sensing electronics to the end of the assembly that is grounded due to the complications associated with doing high-sensitivity current measurements at high voltage.

Other alternate configurations, such as applying the voltage Vcc at the capillary tip 105, and sensing the current at the capillary tip 105 or at the counter-electrode 103, are also possible. In all these configurations, the modulation frequency of the ESI currents is used as a spray mode indicator to optimize the electrospray performance so that the maximum detection sensitivity is achieved. For example, the tip to counter-electrode voltage may be adjusted such that the electrospray is operating at the highest possible mode II frequency, thus ensuring the formation of the smallest possible initial droplets downstream from the tip 111 of the Taylor cone 109. Alternatively, the tip to counter-electrode voltage may be actively adjusted for the electrospray to operate in Mode III, at a voltage just above the Mode II threshold. In mode III, the Taylor cone 109 remains in a stable position, but the filament 113 may break up due to transversal perturbations. The choice of the tip to counter-electrode voltage adjustment algorithm will depend on a mass-spectrometer signal sensitivity analysis for a particular capillary tip and counter-electrode interface.

In another embodiment, the voltage-controlled high-voltage power supply 409 is replaced with a voltage-controlled flow rate controller that adjusts the flow rate of the fluid in the capillary tip 105 in response to the output voltage $V_{out}$ so that the desired spray mode is maintained.

In yet another embodiment, the capillary tip to counter-electrode voltage Vcc has a DC component with a superimposed AC waveform. The DC offset is used to establish the highest possible field where there is no electrospray action. High-voltage AC pulses are superimposed to the DC offset in order to elicit on-demand droplet formation. The AC pulses may be a sinusoidal, square, triangular or arbitrary waveform. The shape and duty cycle of the pulses can be altered to actively control the axial oscillations of the Taylor cone, and thus create drops with optimized charge to mass ratios. Moreover, the active drop formation may be synchronized to the sampling electronics of the mass-spectrometer in order to ensure the best sensitivity and repeatability. The AC pulses can be created using appropriate high voltage amplifier circuits.

For best results in all embodiments, the tip-counter-electrode system is shielded from interfering signals such that the ESI current measurements are performed at the highest possible signal-to-noise ratio. Otherwise interfering signals from surrounding electronics may add frequency content to the measured signal. Proper shielding can be achieved by surrounding the tip and counter-electrode module 413 with a grounded conductive (e.g., stainless steel) enclosure. The connections in and out of the enclosure can be accomplished using coaxial cables.

In yet another embodiment, the wetting characteristics of the capillary tip 105 is optimized to produce repeatable Taylor cone characteristics. A hydrophobic capillary tip 105 guarantees a constant radius $R_b$ of the Taylor cone base 119 (see FIG. 1), which in this case would coincide with the diameter of the capillary tip 105. Since the modulation frequency can change drastically depending on the radius of the Taylor cone base 119, precise control of the radius is imperative for achieving a high level of repeatability of the ESI. One way to maintain the non-wetting characteristics of the capillary tip 105 is to coat the capillary tip 105 with a hydrophobic film. For example, the capillary tip 105 can be coated by immersion or molecular vapor deposition with a fluorocarbon. Examples of fluorocarbon include, but are not limited to, such as tridecafluoro-1,1,2,2-tetrahydrooctyl-trichlorosilane (FOTS), polytetrafluoroethylene (PTFE), and polyvinylidene fluoride (PVDF). If the tip surface is hydrophobic and the film is robust, the radius of the Taylor cone base 119 will remain constant for a given electrospray configuration and settings.

In another embodiment, the tip and counter-electrode interface is optimized by preventing external perturbations of the Taylor cone 109. For example, the drying gas flow 123 can be adjusted to minimize its interactions with the Taylor cone 109, or the capillary tip 105 may be positioned off-axis from the counter flow at angles of up to 90 degrees from the axis of the aperture 121.

Figure 5:
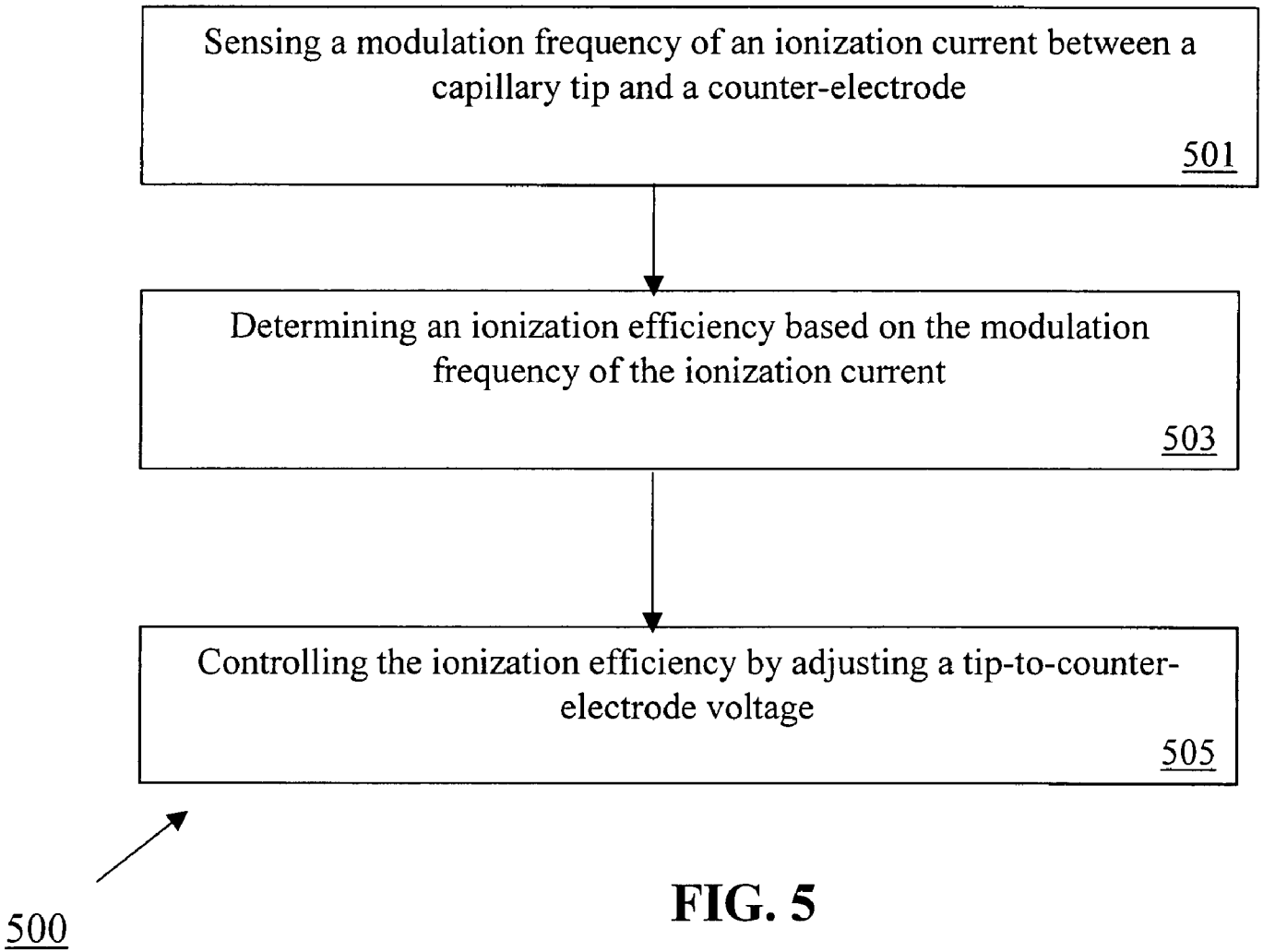
FIG. 5 is a flow-chart of a method for providing ions to a mass spectrometer using a feedback loop control based on the modulation frequency.

FIG. 5 shows a method 500 for providing ions to a mass spectrometer. The method 500 contains sensing (501) a modulation frequency of an ionization current, determining (503) an ionization efficiency based on the modulation frequency of the ionization current, and controlling (505) the ionization efficiency by adjusting a voltage between the capillary tip and the counter-electrode.

In another embodiment, the ionization efficiency is controlled by adjusting the flow rate of the sample fluid.

We claim:

1. An ion source for controlling charged molecules in an ion spray, comprising:

a capillary tip having a central longitudinal axis;

a counter-electrode downstream from the capillary tip having a central axis and an aperture along the central axis for receiving ions ejected from the capillary tip; and a closed feedback loop for coupling the capillary tip to the counter-electrode and regulating the ion spray produced from the capillary tip, wherein the closed feedback loop maintains ionization efficiency by measuring a modulation frequency of ionization currents and adjusting a tip to counter-electrode voltage.

2. The ion source of claim 1, wherein the central longitudinal axis of the capillary tip is situated in transverse relation to the central axis and aperture of the counter-electrode such that charged molecules in the ion spray move from by electrostatic forces from the capillary tip into the aperture of the counter-electrode.

3. The ion source of claim 1, wherein the angle defined between the central longitudinal axis of the capillary tip and the central axis of the counter electrode is about 90 degrees.

4. The ion source of claim 1, wherein the angle defined between the central longitudinal axis of the capillary tip and the central axis of the counter electrode is between about 75 degrees and about 105 degrees.

5. The ion source of claim 1, wherein the ion spray is produced by electrospray ionization.

6. The ion source of claim 1, wherein the capillary tip comprises a hydrophobic material.

7. The ion source of claim 6, wherein the hydrophobic material comprises a hydrophobic coating.

8. The ion source of claim 7, wherein the hydrophobic coating comprises hydrophobic fluorocarbon.

9. The ion source of claim 8, wherein the hydrophobic fluorocarbon is selected from the group consisting of tridecafluoro-1,1,2,2-tetrahydrooctyltrichlorosilane (FOTS), polytetrafluoroethylene (PTFE), and polyvinylidene fluoride (PVDF).

10. The ion source of claim 1, wherein the feedback loop comprises:

a transimpedance amplifier;

a DC de-coupler in electrical connection to the transimpedance amplifier;

a frequency to voltage converter in electrical connection to the DC de-coupler;

a controller in electrical connection to the frequency to voltage converter; and a voltage-controlled high-voltage power supply in electrical connection to the controller, wherein the voltage-controlled high-voltage power supply provides the tip to counter-electrode voltage.

11. The ion source of claim 10, further comprising an amplifier capable of generating high voltage AC pulses.

12. The ion source of claim 10, wherein the transimpedance amplifier is connected to the capillary tip.

13. The ion source of claim 10, wherein the transimpedance amplifier is connected to the counter-electrode.

14. The ion source of claim 10, wherein the controller comprises a microprocessor.

15. The ion source of claim 10, wherein the transimpedance amplifier has a bandwidth of at least 400 kHz.

16. The ion source of claim 10, wherein the voltage-controlled high-voltage power supply is replaced with a voltage-controlled flow-rate controller, and wherein the device measures a modulation frequency of ionization currents, and provides a feedback adjustment of flow rates of a sample fluid in the capillary tip to maintain ionization efficiency.

17. The ion source of claim 1, wherein the counter electrode comprise a portion of a housing and a passageway along the center axis of the counter electrode.

18. The ion source of claim 1, additionally comprising an enclosure to shield the capillary tip and the counter-electrode from interfering signals, wherein the enclosure comprises a conductive material and is grounded.

19. A mass spectrometry system, comprising:

(a) An ion source for controlling charged molecules in an ion spray, comprising:

a capillary tip having a central longitudinal axis;

a counter-electrode downstream from the capillary tip having a central axis and an aperture along the central axis for receiving ions ejected from the capillary tip; and a closed feedback loop for coupling the capillary tip to the counter-electrode and regulating the ion spray produced from the capillary tip, wherein the closed feedback loop maintains ionization efficiency by measuring a modulation frequency of ionization currents and adjusting a tip to counter-electrode voltage; and (b) a detector downstream from the ion source for detecting the ions produced from the ion source.

20. A method for providing ions to a mass spectrometer, comprising:

sensing a modulation frequency of an ionization current between an capillary tip and a counter-electrode;

determining an ionization efficiency based on the modulation frequency of the ionization current; and controlling the ionization efficiency by adjusting a voltage between the capillary tip and the counter-electrode.

21. The method of claim 20, wherein the voltage between the capillary tip and the counter-electrode is adjusted by applying a DC voltage with an AC component superimposed on the DC voltage.

* * * * *